US010435876B2

(12) United States Patent
Shimasaki et al.

(10) Patent No.: US 10,435,876 B2
(45) Date of Patent: Oct. 8, 2019

(54) BUBBLE GENERATOR AND FLUSH TOILET

(71) Applicant: LIXIL Corporation, Tokyo (JP)

(72) Inventors: Hirokazu Shimasaki, Tokyo (JP); Kouji Fukuya, Tokyo (JP); Masato Wakabayashi, Tokyo (JP); Shuhei Haida, Tokyo (JP); Koji Shimizu, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 15/756,558

(22) PCT Filed: Aug. 3, 2016

(86) PCT No.: PCT/JP2016/072853
§ 371 (c)(1),
(2) Date: Feb. 28, 2018

(87) PCT Pub. No.: WO2017/038361
PCT Pub. Date: Mar. 9, 2017

(65) Prior Publication Data

US 2018/0291607 A1 Oct. 11, 2018

(30) Foreign Application Priority Data

Aug. 31, 2015 (JP) ..... 2015-171384

(51) Int. Cl.
*E03D 9/02* (2006.01)
*E03D 11/02* (2006.01)
(Continued)

(52) U.S. Cl.
CPC ..... *E03D 9/02* (2013.01); *B01F 3/0446* (2013.01); *B01F 3/04985* (2013.01);
(Continued)

(58) Field of Classification Search
CPC ..... E03D 9/02
(Continued)

(56) References Cited

U.S. PATENT DOCUMENTS

2018/0266092 A1 9/2018 Fukuya et al.

FOREIGN PATENT DOCUMENTS

CN 102677758 9/2012
JP 6-85476 12/1994
(Continued)

OTHER PUBLICATIONS

International Search Report dated Oct. 18, 2016, directed to International Application No. PCT/JP2016/072853; 2 pages.
(Continued)

*Primary Examiner* — Lori L Baker
(74) *Attorney, Agent, or Firm* — Morrison & Foerster LLP

(57) ABSTRACT

A bubble generator includes an ejector including a flow passage, a water supplier that supplies water into the flow passage, an air supplier that supplies air into the flow passage, a cleaner supplier that supplies a cleaner into the flow passage, and a bubble discharger that discharges bubbles generated by mixing the water, the air, and the cleaner; a water supply device that supplies water to the flow passage via the water supplier, and a cleaner supply device that supplies the cleaner to the flow passage via the cleaner supplier. The cleaner supplier is formed on a lower surface of the flow passage.

3 Claims, 5 Drawing Sheets

(51) Int. Cl.

| | |
|---|---|
| ***B01F 3/04*** | (2006.01) |
| ***B01F 5/04*** | (2006.01) |
| ***B01F 15/02*** | (2006.01) |
| ***E03D 9/00*** | (2006.01) |

(52) U.S. Cl.
CPC ..... *B01F 5/043* (2013.01); *B01F 5/0405* (2013.01); *B01F 15/024* (2013.01); *E03D 9/00* (2013.01); *E03D 9/005* (2013.01); *E03D 11/02* (2013.01); *B01F 2215/004* (2013.01); *B01F 2215/008* (2013.01)

(58) Field of Classification Search
USPC ..... 4/223
See application file for complete search history.

(56) References Cited

FOREIGN PATENT DOCUMENTS

| | | |
|---|---|---|
| JP | 8-302796 | 11/1996 |
| JP | 9-4025 | 1/1997 |
| JP | 2003-27557 | 1/2003 |
| JP | 2004-100331 | 4/2004 |
| JP | 2008-138420 | 6/2008 |
| JP | 2008-138422 | 6/2008 |
| JP | 2008-240442 | 10/2008 |
| JP | 2009-256917 | 11/2009 |
| JP | 2013-234526 | 11/2013 |
| KR | 10-2011-0008973 | 1/2011 |
| KR | 10-2013-0077763 | 7/2013 |

OTHER PUBLICATIONS

International Preliminary Report on Patentability dated Mar. 6, 2018, directed to International Application No. PCT/JP2016/072853; 11 pages.
Decision to Grant Patent dated Jan. 8, 2019, directed to Japanese Application No. 2015-171384; 6 pages.
Extended European Search Report dated Mar. 29, 2019, directed to European Patent Application No. 16841393.8; 6 pages.
Fukuya et al., U.S. Office Action dated Feb. 7, 2019, directed to U.S. Appl. No. 15/756,560; 10 pages.
International Preliminary Report on Patentability dated Mar. 6, 2018, directed to International Application No. PCT/JP2016/072854; 11 pages.
International Search Report dated Oct. 18, 2016, directed to International Application No. PCT/JP2016/072854; 2 pages.
Notification of Reason(s) for Refusal dated Jan. 8, 2019, directed to Japanese Patent Application No. 2015-171385; 5 pages.
Partial European Search Report dated Apr. 1, 2019, directed to European Patent Application No. 16841394.6; 10 pages.

BUBBLE GENERATOR AND FLUSH TOILET

REFERENCE TO RELATED APPLICATIONS

This application is a national stage application under 35 USC 371 of International Application No. PCT/JP2016/072853, filed Aug. 3, 2016, which claims the priority of Japanese Application No. 2015-171384, filed Aug. 31, 2015, the entire contents of each of which are incorporated herein by reference.

FIELD OF THE INVENTION

The present invention relates to flush toilets, and more particularly to a flush toilet capable of supplying bubbles into a toilet bowl part.

BACKGROUND OF THE INVENTION

Conventionally known are flush toilets that supply flush water mixed with bubbles to a toilet bowl part. By spreading bubbles on a water surface of the toilet bowl part, for example it is possible to suppress scattering of a liquid at the time of urination by a male person or to wash the toilet bowl part.

As a method of supplying flush water mixed with bubbles to a toilet bowl part, a method of providing, in a flow passage of flush water through which flush water flows, a device called ejector that narrows the diameter of a part of the passage is proposed (for example, Patent Document 1). The air and a cleaner are externally supplied to the ejector. When flush water for washing the interior of the toilet bowl part flows into the ejector, an ejector effect is generated in which the interior of the ejector is negatively pressured. The air is drawn into the ejector by this ejector effect, and the flush water, the air and the cleaner are mixed to generate bubbles which flow into the toilet bowl part as bubble-mixed flush water.

[patent document 1] JP 2008-138422 A

SUMMARY OF THE INVENTION

However, in the conventional method of supplying bubbles as described above, when the cleaner is left in a supplier of the cleaner for a long period of time, there is a possibility that the cleaner dries and adheres to the supplier, making it difficult to supply the cleaner to the flow passage of flush water, and that sufficient bubbles cannot be generated.

The present invention has been made in view of such problems, and it is an object of the present invention to provide a bubble generator and a flush toilet capable of suitably generating bubbles by preventing adhesion of a cleaner.

In order to solve the above problems, a bubble generator according to an aspect of the present invention includes: a flow passage; a water supplier that supplies water into the flow passage; an air supplier that supplies air into the flow passage; a cleaner supplier that supplies a cleaner into the flow passage; a bubble discharger that discharges bubbles generated by mixing the water, the air, and the cleaner; a water supply device that supplies water to the flow passage via the water supplier; and a cleaner supply device that supplies the cleaner to the flow passage via the cleaner supplier. The cleaner supplier is formed on a lower surface of the flow passage.

According to this aspect, the cleaner supplier is brought into contact with water each time water flows through the flow passage since the cleaner supplier is formed on the lower surface of the flow passage of the ejector, whereby drying of the cleaner supplier can be suppressed, and adhesion of the cleaner can be prevented. As a result, an adequate amount of cleaner can be supplied to the flow passage, and bubbles can be suitably generated.

Another aspect of the present invention is a flush toilet. The flush toilet includes: a toilet bowl part; a bubble passage that guides bubbles toward the toilet bowl part; and the bubble generator described above and provided in the bubble passage. According to this aspect, it is possible to provide a flush toilet capable of suitably discharging bubbles to the toilet bowl part.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
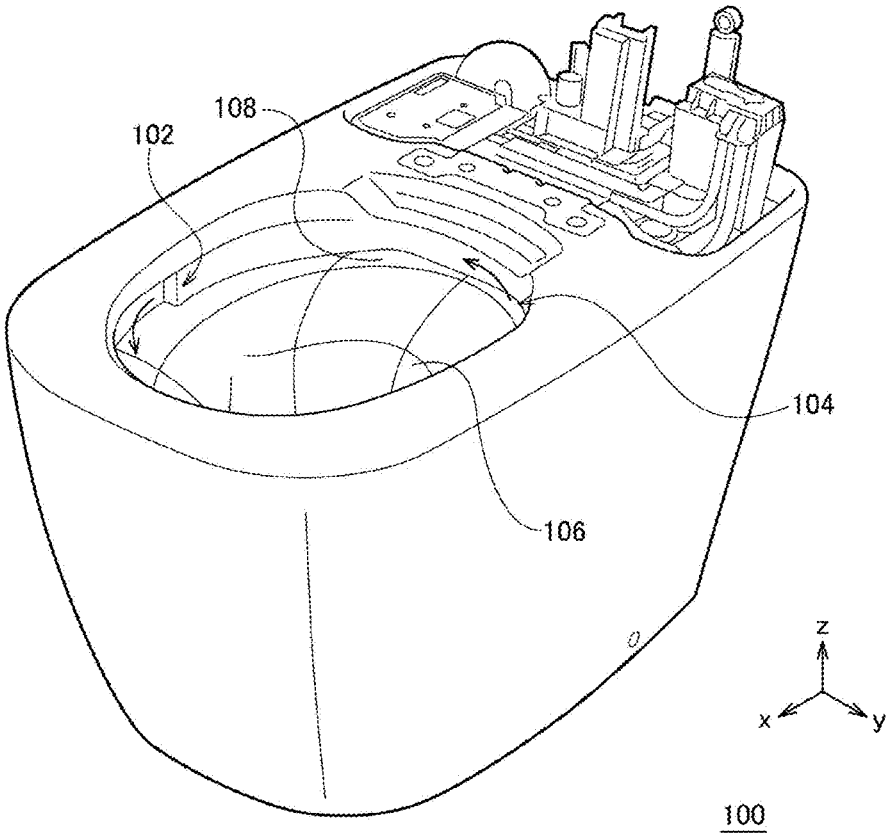
FIG. 1 is a front perspective view of a flush toilet according to an embodiment of the present invention.

A flush toilet according to an embodiment of the present invention will be described in detail below with reference to the drawings. The same or equivalent components, members, and processing illustrated in the drawings are denoted by the same reference numerals, and redundant descriptions will be omitted as appropriate. Moreover, embodiments do not limit the invention but examples. All the characteristics or combinations thereof described in the embodiments are not necessarily essential to the invention.

FIG. 1 is a front perspective view of a flush toilet 100. The flush toilet 100 illustrated in FIG. 1 has a flush water tank and a flush water pump built therein. The flush water pump discharges flush water stored in the flush water tank from a first water discharge port 102 and a second water discharge port 104 to a toilet bowl part 106. The flush water discharged from the second water discharge port 104 flows on a water guide shelf 108 (rail) formed on an inner wall surface of the toilet bowl part 106 and merges with the flush water discharged from the first water discharge port 102 to swirl inside the toilet bowl part 106 to fall. Note that a functional units (not illustrated) for providing a local washing function, a warm air function, or other functions may be mounted on a rear end portion of the flush toilet 100.

Figure 2:
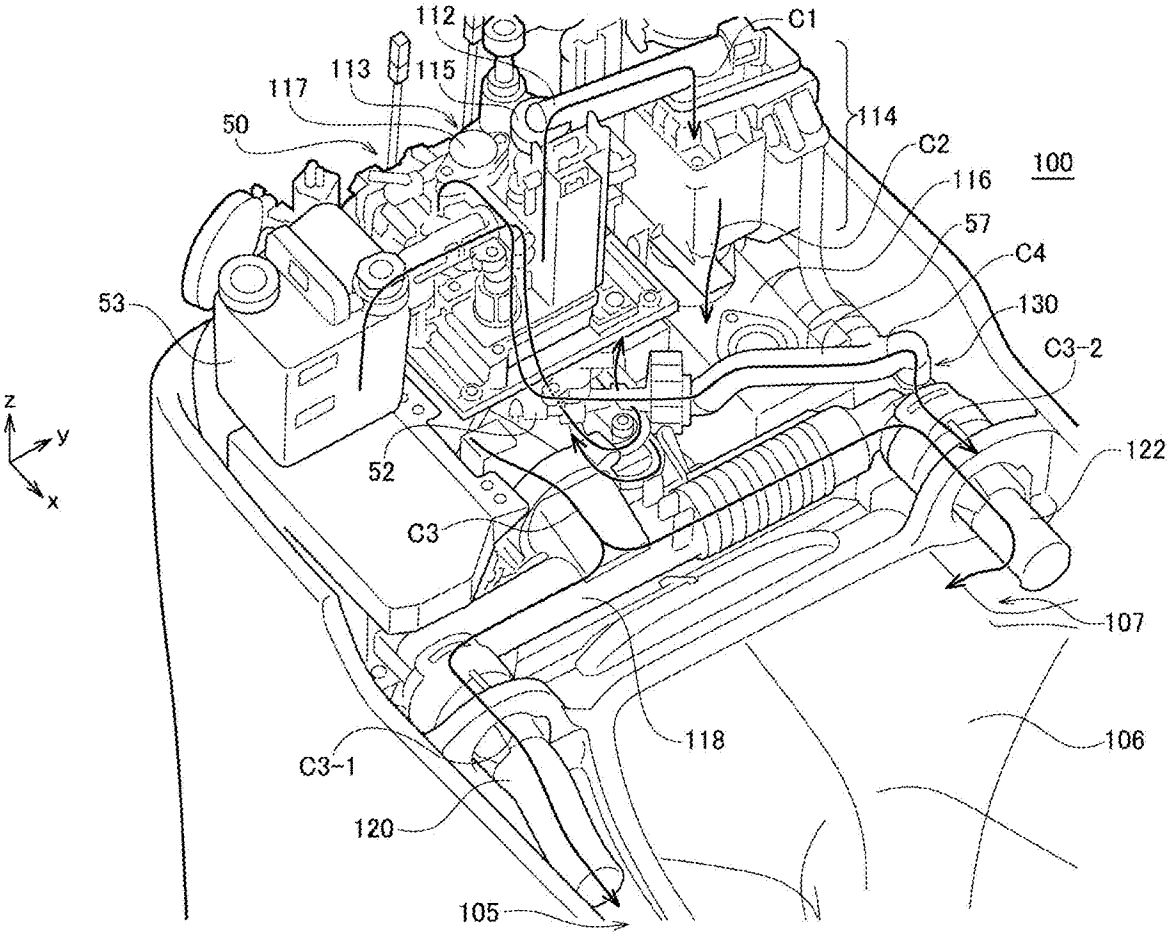
FIG. 2 is an enlarged perspective view of the inside of a rear end of the flush toilet according to the embodiment of the present invention.
Figure 3:
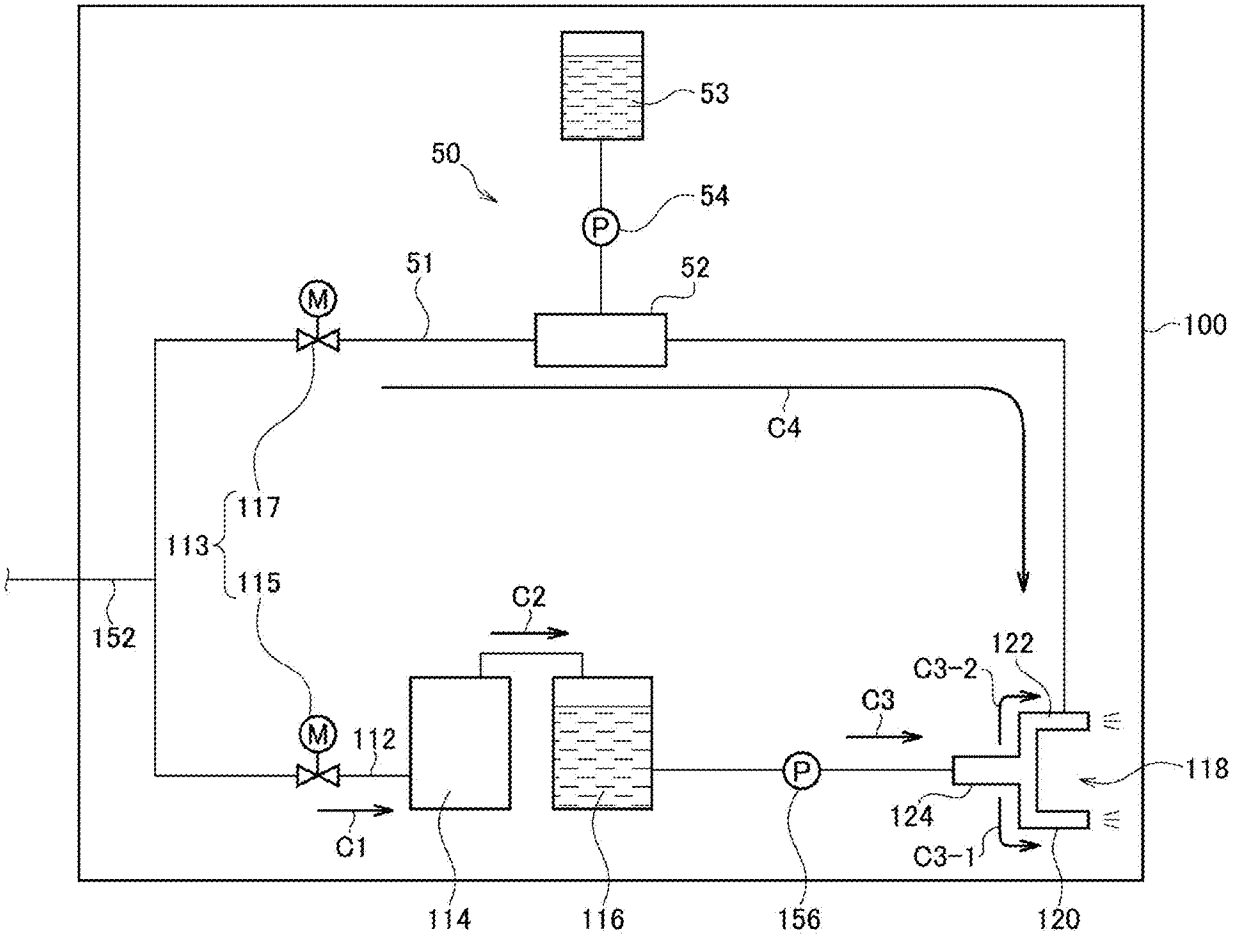
FIG. 3 is a configuration diagram of the flush toilet according to the embodiment of the present invention.
Figure 4:
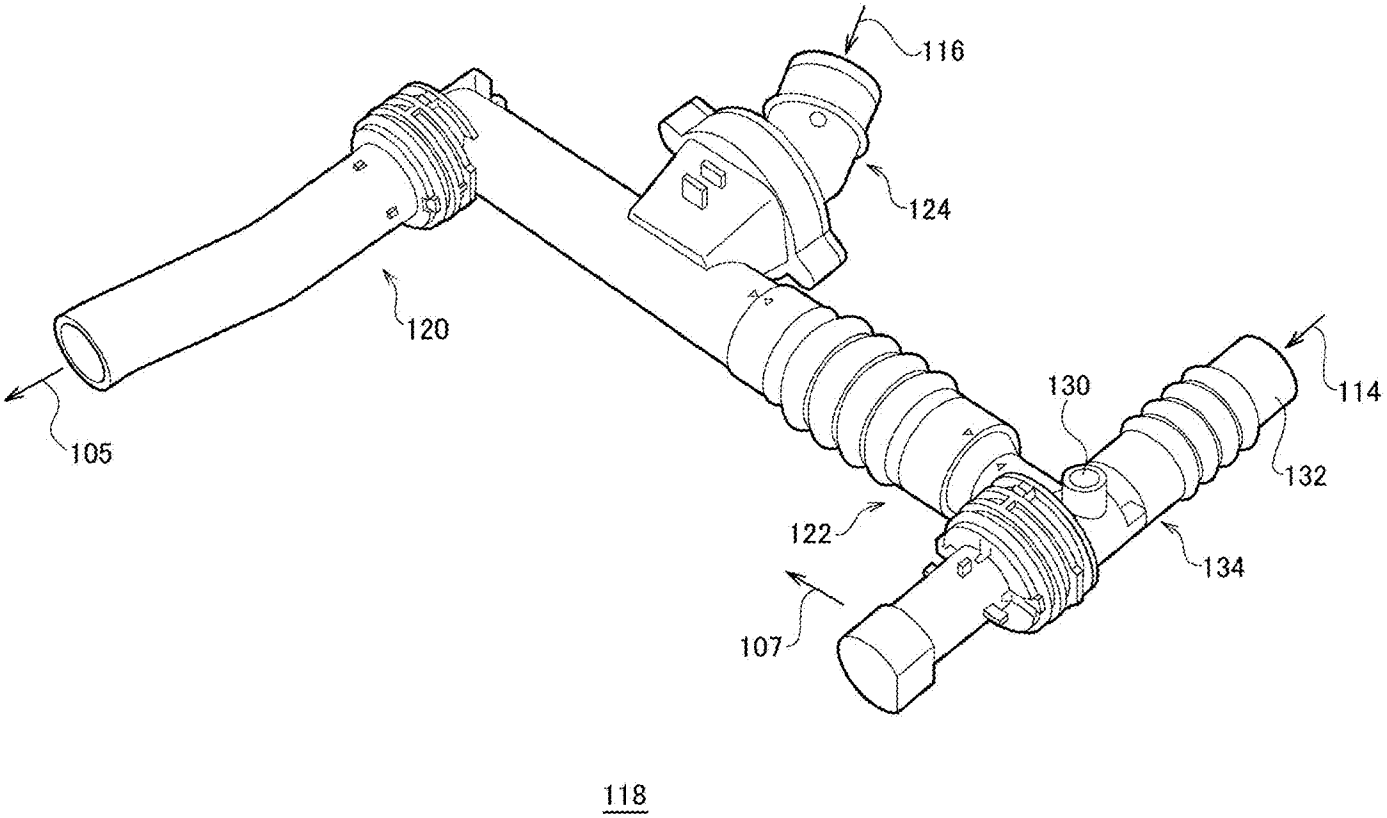
FIG. 4 is an external perspective view of a water discharge pipe.

FIG. 2 is an enlarged perspective view of the inside of a rear end of the flush toilet 100. FIG. 3 is a configuration diagram of the flush toilet 100. FIG. 4 is an external perspective view of the water discharge pipe.

As illustrated in FIGS. 2 and 3, the flush toilet 100 includes a valve unit 113. The valve unit 113 is connected to a water supply pipe 152 (see FIG. 3) connected to waterworks. The valve unit 113 includes a flush water valve 115 and a bubble valve 117 (the valve unit 113 will be described later). When the flush water valve is opened, flush water enters a water receiver 114 via a replenishment pipe 112 (see FIG. 2) (route C1). The flush water of the water receiver 114 flows into a flush water tank 116 therebelow as it is and is stored in the flush water tank 116 (route C2).

When a user operates a flush button (not illustrated), a flush water pump 156 (see FIG. 3) in a lower part of the flush toilet 100 operates, and the flush water in the flush water tank 116 is sent to a water discharge pipe 118 (route C3). The water discharge pipe 118 branches from a main pipe 124 to two pipes of a first water discharge pipe 120 and a second water discharge pipe 122. The flush water having flowed from the main pipe 124 to the first water discharge pipe 120 is discharged from the first water discharge port 102 via a first flush water conduit 105 (route C3-1). Meanwhile, the flush water having flowed from the main pipe 124 to the second water discharge pipe 122 is discharged from the second water discharge port 104 via a second flush water conduit 107 (route C3-2). The flush water valve 115, the water receiver 114, the flush water tank 116, and the flush water pump 156 form a flush water supply mechanism that supplies flush water to the toilet bowl part 106.

The water receiver 114 communicates not only with the flush water tank 116 but also with an overflow pipe 132 (see FIG. 4) communicating with an overflow passage (not illustrated). The flush water in the water receiver 114 is supplied to the flush water tank 116. However, when the amount of stored water in the flush water tank 116 is excessively increased due to a failure of the valve unit 113 or other reasons, flush water overflows from the water receiver 114. Therefore, an overflow of water is prevented by allowing the water receiver 114 to discharge excessive flush water to the overflow pipe 132. The overflow pipe 132 discharges the excessive water from a discharge port 134, and the discharge port 134 in this embodiment is coupled to the second water discharge pipe 122 (see FIG. 4). Therefore, the excessive water in the water receiver 114 is discharged into the toilet bowl part 106 via the second flush water conduit 107 and the second water discharge port 104.

The routes C1, C2, C3, C3-1, and C3-2 described above form a flush water conduit for guiding flush water toward the toilet bowl part 106. That is, up to the first water discharge port 102 or the second water discharge port 104 (before the toilet bowl part 106) is included in the flush water conduit. In the flush toilet 100 according to the present embodiment, a bubble passage (route C4) for guiding bubbles toward the toilet bowl part 106 is provided separately from the flush water conduit. In this bubble passage, a bubble generator 50 for generating bubbles is provided. Hereinafter, the bubble generator 50 will be described in detail.

Figure 5:
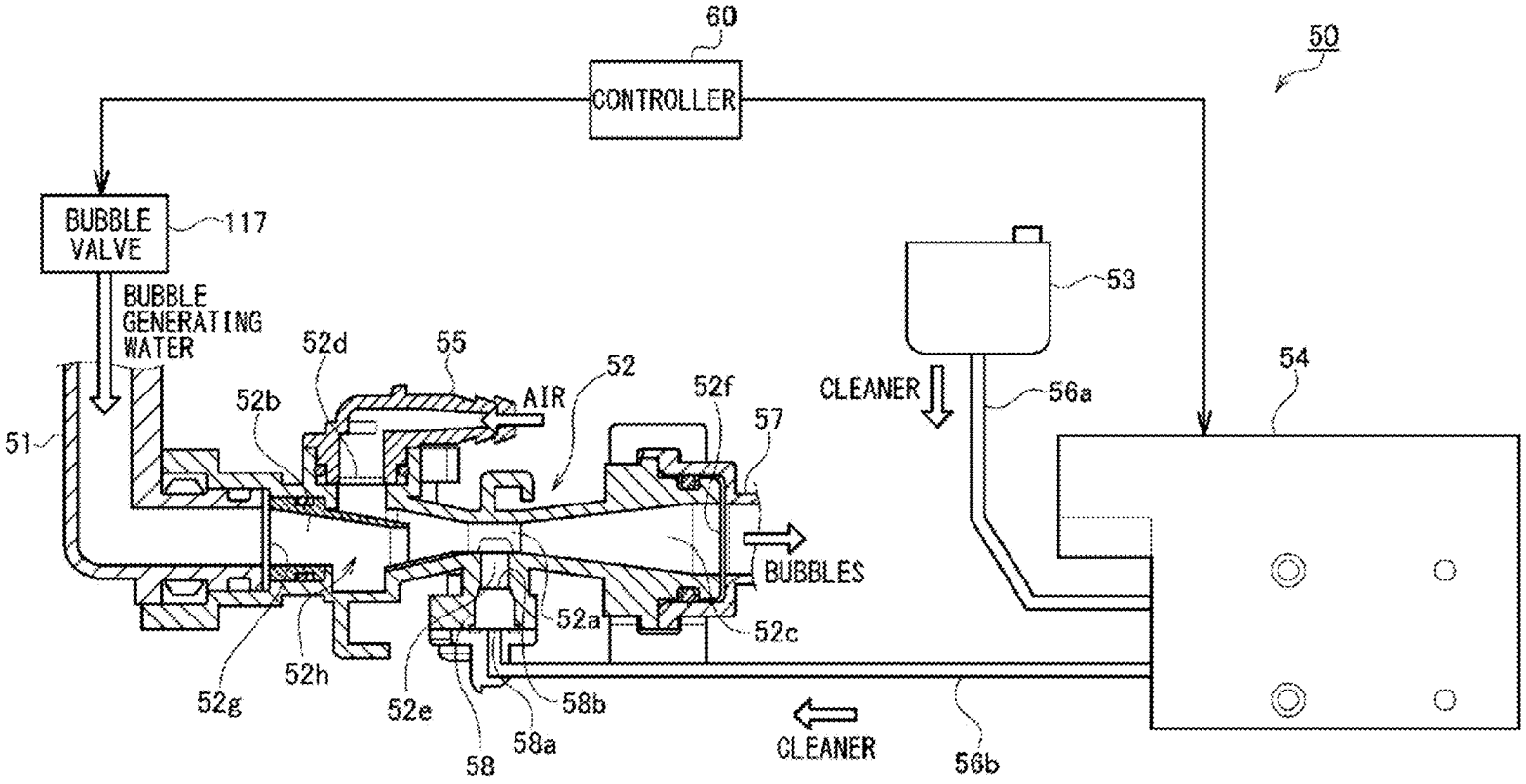
FIG. 5 is a diagram for explaining a configuration of a bubble generator according to the embodiment of the present invention.

FIG. 5 is a diagram for explaining a configuration of the bubble generator 50 according to the embodiment of the present invention. As illustrated in FIG. 5, the bubble generator 50 includes an ejector 52, the bubble valve 117 (see FIG. 2), a controller 60, a water supply pipe 51, a cleaner tank 53, a cleaner pump 54, a first hose 56*a*, and a second hose 56*b*.

The ejector 52 has a tubular body having a flow passage 52*h* therein. In the flow passage 52*h* of the ejector 52, the diameter of an intermediate part of the flow passage is narrower than the diameter of the upstream or the downstream flow passage. The part with a narrower diameter of flow passage is called a "small diameter part 52*a*", the upstream side from the small diameter part 52*a* is called an "upstream part 52*b*", and the downstream side from the small diameter part 52*a* is called a "downstream part 52*c*".

On an upstream side of the upstream part 52*b* of the ejector 52, a water supplier 52*g* for supplying water into the flow passage is provided, and a water supply pipe 51 is connected to the water supplier 52*g*. The water supply pipe 51 is connected to the bubble valve 117. The bubble valve 117 and the water supply pipe 51 form a water supply device that supplies water (hereinafter referred to as "bubble generating water" as appropriate) to the flow passage 52*h* of the ejector 52. When the bubble valve is opened by a command from the controller 60, bubble generating water flows into the flow passage 52*h* via the water supply pipe 51 and the water supplier 52*g*.

On an upper surface of the upstream part 52*b* of the ejector 52, an air supplier 52*d* for introducing the air into the ejector 52 is provided, and an air supply pipe 55 is connected to the air supplier 52*d*.

On a lower surface of the small diameter part 52*a* of the ejector 52, a cleaner supplier 52*e* for introducing the cleaner into the ejector 52 is provided. The cleaner supplier 52*e* is formed into a stepped shape lower than the flow passage surrounding the cleaner supplier. The step of the cleaner supplier 52*e* is formed to such a degree that water is pooled therein. A duckbill valve 58 is arranged below the cleaner supplier 52*e*. The second hose 56*b* extending from the cleaner pump 54 is connected to an inlet opening 58*a* of the duckbill valve 58. An outlet opening 58*b* of the duckbill valve 58, which is a cleaner supply port for discharging the cleaner, is arranged on a bottom surface of the cleaner supplier 52*e* of the step shape. The duckbill valve 58 is a check valve that allows a fluid to pass from the inlet opening 58*a* toward the outlet opening 58*b* but does not allow the fluid to pass from the outlet opening 58*b* toward the inlet opening 58*a*.

The cleaner tank 53 stores the cleaner. The cleaner pump 54 is connected to the cleaner tank 53 via the first hose 56*a* and is connected to the cleaner supplier 52*e* of the ejector 52 via the second hose 56*b* and the duckbill valve 58. The cleaner pump 54 operates in response to a command from the controller 60. The cleaner tank 53, the cleaner pump 54, the first hose 56*a*, the second hose 56*b*, and the duckbill valve 58 form a cleaner supply device that supplies the cleaner to the flow passage 52*h* via the cleaner supplier 52*e*.

On a downstream side of the downstream part 52*c* of the ejector 52, there is provided a bubble discharger 52*f* for discharging bubbles generated by mixing the bubble generating water, the air, and the cleaner in the ejector 52, and the bubble discharger 52*f* is connected with a bubble pipe 57 for discharging bubbles toward the toilet bowl part 106.

In the bubble generator 50 configured as described above, when a user operates the flush button, the controller 60 controls the bubble valve 117 to be in an open state, whereby the bubble generating water is supplied into the water supply pipe 51. This bubble generating water flows into the flow passage 52*h* of the ejector 52. Furthermore, the controller 60 operates the cleaner pump 54 at the same timing as when the bubble valve 117 is opened. As a result, the cleaner stored in the cleaner tank 53 passes through the first hose 56*a*, then is sucked into the cleaner pump 54, and is discharged from the cleaner pump 54 to the second hose 56*b*. The cleaner having passed through the second hose 56*b* flows into the cleaner supplier 52*e* via the duckbill valve 58 and is supplied into the flow passage 52*h* from the cleaner supplier 52*e*. When the bubble generating water flows into the flow passage 52*h* of the ejector 52, an ejector effect is generated in which the interior of the ejector is negatively pressured. By this ejector effect, the air is drawn into the flow passage 52*h* of the ejector 52 from the air supplier 52*d*, and the flush water, the air, and the cleaner are mixed in the flow passage 52*h* to generate bubbles. The bubbles generated in the flow passage 52*h* flow into the bubble pipe 57 from the bubble discharger 52*f*. The tip portion (bubble discharge port 130) of the bubble pipe 57 is connected to the flush water passage (second water discharge pipe 122). The bubbles are discharged from the second water discharge port 104 together with the flush water (see FIG. 2).

As described above, in the bubble generator 50 of the present embodiment, the cleaner supplier 52*e* is formed on the lower surface of the flow passage 52*h* of the ejector 52. As a result, the cleaner supplier 52*e* is brought into contact with water each time water flows through the flow passage 52*h*, whereby drying of the cleaner supplier 52*e* can be suppressed, and adhesion of the cleaner can be prevented.

Furthermore in the present embodiment, the cleaner supplier 52*e* is formed into the stepped shape lower than the flow passage surrounding the cleaner supplier, and the outlet opening 58*b* of the duckbill valve 58, which is a cleaner supply port, is arranged on a bottom surface of the cleaner supplier 52*e* of the stepped shape. As a result, water is easily pooled in the cleaner supplier 52*e*, and thus drying of the outlet opening 58*b* of the duckbill valve 58 is suppressed, and adhesion of the cleaner can be prevented. By preventing the cleaner from adhering to the outlet opening 58*b* of the duckbill valve 58, an adequate amount of cleaner can be supplied to the flow passage 52*h*, and bubbles can be suitably generated.

In the bubble generator 50 of the present embodiment, the controller 60 may periodically flush water to the flow passage 52*h*. In this case, the controller 60 does not operate the cleaner pump 54. By periodically flushing water to the flow passage 52*h* in this manner, even in a case where the bubble generator 50 is not used for a long time, adhesion of the cleaner can be prevented. It is not necessary to flush a large amount of water to the flow passage 52*h*. It is sufficient to flush an amount enough to allow enough water to be pooled in the cleaner supplier 52*e* of the stepped shape. Furthermore, an interval for flushing water to the flow passage 52*h* may be set to a time length required for water to evaporate and to disappear from the cleaner supplier 52*e* of the stepped shape. That is, if water disappears from the cleaner supplier 52*e* of the stepped shape in, for example, about 15 hours, it is sufficient to flush water to the flow passage 52*h* every 15 hours.

The present invention has been described above on the basis of the embodiments. These embodiments are merely illustration. Therefore, it should be understood by a person skilled in the art that combinations of the components or processing processes may include various variations and that such a variation is also within the scope of the present invention.

For example, in the embodiment described above, the bubble passage is provided separately from the flush water conduit; however, the flush water conduit and the bubble passage may be the same. That is, the bubble generator may be provided in the flush water conduit.

Generalizing the invention embodied by the above embodiment leads to the following technical ideas.

In the aspect described in the means to solve the problem, the cleaner supplier may be formed into the stepped shape lower than the flow passage surrounding the cleaner supplier, and the cleaner supply port of the cleaner supply device may be formed on the bottom surface of the cleaner supplier. In this case, water is easily pooled in the cleaner supplier, and thus drying of the cleaner supply port is suppressed, and adhesion of the cleaner to the cleaner supply port can be prevented.

The water supply device may be configured to periodically flush water to the flow passage. In this case, even in the case where the bubble generator is not used for a long time, adhesion of the cleaner can be prevented.

The invention claimed is:

1. A bubble generator, comprising:

a flow passage;

a water supplier that supplies water into the flow passage;

an air supplier that supplies air into the flow passage;

a cleaner supplier that supplies a cleaner into the flow passage;

a bubble discharger that discharges bubbles generated by mixing the water, the air, and the cleaner;

a water supply device that supplies water to the flow passage via the water supplier; and a cleaner supply device that supplies the cleaner to the flow passage via the cleaner supplier, wherein the cleaner supplier is formed on a lower surface of the flow passage, the cleaner supplier is formed into a stepped shape lower than the flow passage surrounding the cleaner supplier, and a cleaner supply port of the cleaner supply device is arranged on a bottom surface of the cleaner supplier.

2. The bubble generator of claim 1, wherein the water supply device is configured to periodically flush water to the flow passage.

3. A flush toilet, comprising:

a toilet bowl part;

a bubble passage that guides bubbles toward the toilet bowl part; and the bubble generator of claim 1, the bubble generator provided in the bubble passage.

* * * * *